US010655887B2

(12) United States Patent
Yang et al.

(10) Patent No.: US 10,655,887 B2
(45) Date of Patent: May 19, 2020

(54) VENTILATING DEVICE

(71) Applicant: Panasonic Ecology Systems Guangdong Co., Ltd., Foshan, Guangdong (CN)

(72) Inventors: Decong Yang, Guangdong (CN); Guofeng Pang, Guangdong (CN); Wentian Gong, Guangdong (CN); Runxin Chen, Guangdong (CN)

(73) Assignee: Panasonic Ecology Systems Guangdong Co., Ltd., Foshan, Guangdong (CN)

( * ) Notice: Subject to any disclaimer, the term of this patent is extended or adjusted under 35 U.S.C. 154(b) by 120 days.

(21) Appl. No.: 16/031,043

(22) Filed: Jul. 10, 2018

(65) Prior Publication Data

US 2019/0032951 A1 Jan. 31, 2019

(30) Foreign Application Priority Data

Jul. 27, 2017 (CN) ..... 2017 2 0926752 U

(51) Int. Cl.

| | |
|---|---|
| ***F24F 11/89*** | (2018.01) |
| ***F24F 7/007*** | (2006.01) |
| ***F24F 110/10*** | (2018.01) |
| ***F24F 110/20*** | (2018.01) |
| ***F24F 13/20*** | (2006.01) |

(52) U.S. Cl.

CPC ..... *F24F 11/89* (2018.01); *F24F 7/007* (2013.01); *F24F 2013/205* (2013.01); *F24F 2110/10* (2018.01); *F24F 2110/20* (2018.01)

(58) Field of Classification Search

CPC ..... F24F 11/89; F24F 7/007; F24F 2110/10; F24F 2110/20; F24F 2013/205

See application file for complete search history.

(56) References Cited

FOREIGN PATENT DOCUMENTS

JP 2017009249 A * 1/2017

* cited by examiner

*Primary Examiner* — Jessica Yuen

(74) *Attorney, Agent, or Firm* — RatnerPrestia

(57) ABSTRACT

A ventilating device includes: a frame formed with an external profile; an air inlet provided in the frame; an air outlet provided in the frame; an air blower for guiding air from the air inlet to the air outlet; a control circuit board connected to the air blower and configured to control operation of the air blower; and a circuit board box for housing the control circuit board; wherein the circuit board box comprises an integrally formed sensor storage unit for storing a sensor connected to the control circuit board and capable of sensing humidity or temperature. The ventilating device of the present disclosure may use less components, facilitate assembly and disassembly of components, and improve convenience in maintenance.

17 Claims, 8 Drawing Sheets

VENTILATING DEVICE

CROSS REFERENCE TO RELATED APPLICATIONS

This application claims priority to Chinese Patent Application No. 201720926752.X, filed Jul. 27, 2017, the contents of such application being incorporated by reference herein.

BACKGROUND OF THE INVENTION

Field of the Invention

The present disclosure relates to a ventilating device and more particularly to a ventilating device with a temperature/humidity sensor.

Description of the Related Art

FIG. 1 is a schematic diagram of a connection between a sensor and a circuit board box in a ventilating device in a related art. As shown in FIG. 1, in the ventilating device 10 of the related art, in order to more accurately detect temperature or humidity of air entering from an air inlet, a sensor 1 that senses the temperature or humidity is provided at a place proximate to the air inlet. However, since the sensor 1 needs to be connected with the circuit board so as to be controlled and be powered by the same, in the related art, a circuit board (not shown) with a terminal (not shown) is provided in a circuit board box 2, and a dead 3 is used to connect the sensor 1 to a terminal.

However, since the circuit board and the sensor 1 are connected via the lead 3, when the sensor needs maintenance, the lead 3 connected to the circuit board should be removed before removing the sensor 1 from a frame 4. Similarly, when the circuit board needs maintenance, the lead 3 connected to the sensor 1 should be removed before removing the circuit board box 2 provided with the circuit board. That is, work or operation may not be performed conveniently before the maintenance is actually performed.

SUMMARY OF THE INVENTION

(I) Technical Problems to be Solved

As described above, the ventilating device, the sensor, or the circuit board box in the related art is laborious to install and remove such that it has a low convenience in the maintenance or replacement thereof.

In order to solve the above problems, the present disclosure provides a ventilating device that may use less components, facilitate assembly and disassembly of components, and improve convenience in maintenance.

(II) Technical Solution

The present disclosure provides a ventilating device, comprising: a frame formed with an external profile; an air inlet provided in the frame; an air outlet provided in the frame; an air blower for guiding air from the air inlet to the air outlet; a control circuit board connected to the air blower and configured to control operation of the air blower; and a circuit board box for housing the control circuit board; wherein the circuit board box comprises an integrally formed sensor storage unit for storing a sensor connected to the control circuit board and capable of sensing humidity or temperature.

In an embodiment of the present disclosure, the ventilating device further comprises a terminal connected to the air blower and provided on the control circuit board, the control circuit board and a lead of the air blower being connected to each other through the terminal; and an operation opening provided in the circuit board box and opposite to the terminal.

In an embodiment of the present disclosure, the ventilating device further comprises a cover for covering the operation opening; and an insertion opening for guiding the lead to the circuit board box.

In an embodiment of the present disclosure, the air blower comprises: a motor; a first air suction port provided proximate to the motor; a second air suction port opposite to the first air suction port; an air discharge port for discharging air from the air blower; and a fan configured to guide air from the first air suction port and the second air suction port into the air blower and discharge the air from the air blower via the air discharge port simultaneously.

In an embodiment of the present disclosure, the frame comprises: a first side surface provided with the air inlet; a second side surface opposite to the first side surface and provided with the air outlet corresponding to the air discharge port; a top surface adjacent to the first side surface and facing the first air suction port; a bottom face adjacent to the first side surface and facing the second air suction port; and a third side surface and a fourth side surface that are adjacent to the top surface and the bottom surface, respectively; wherein, the circuit board box is provided between the third side surface and the air blower or between the fourth side surface and the air blower.

In an embodiment of the present disclosure, the ventilating device further comprises a first air path for communicating the air inlet with the first air suction port; and a second air path for communicating the air inlet with the second air suction port; wherein a distance from the first air suction port to the top surface is greater than a distance from the second air suction port to the bottom surface, and the sensor storage unit is provided at a second air path side.

In an embodiment of the present disclosure, the sensor storage unit is provided with an air entrance port provided in a face of the sensor storage unit facing the air inlet and configured to guide the air into the sensor storage unit.

In an embodiment of the present disclosure, a first end of the sensor storage unit is provided on a wall of the circuit board box, and a second end of the sensor storage unit extends outwards from the circuit board box.

In an embodiment of the present disclosure, the air entrance port is provided at the second end.

(III) Benefits

As can be seen from the above technical solution, the ventilating device of the present disclosure has at least one of the following beneficial effects:

(1) The circuit board box and the sensor storage unit are integrally formed into one piece. When the sensor or the control circuit board needs to be maintained or removed, by only removing the circuit board box integrally molded with the sensor storage unit, the sensor or the control circuit board may be maintained or replaced as required without being assembled or disassembled separately, thereby easing their replacements and reducing labor-hours. At the same time, only one mold may be used to create the sensing unit and the circuit board box, which can save the mold cost. It can be seen that with such a design, it can simultaneously achieve the effects of easy assembly and disassembly of the components, improving the convenience of maintenance and saving cost.

(2) The circuit board box is disposed in a space between the third side surface and the air blower, or a space between the fourth side surface and the air blower, that is, the circuit board box is disposed in a space with a small air flow, and the effect of the circuit board box upon the air flow may be minimized, so that the circuit board box may be provided without affecting an air volume.

(3) In order to facilitate maintenance of the circuit board box, an operation opening is provided at a position opposite to the terminal provided on the control circuit board, and the lead connected with the air blower can be freely attached to or detached from the control circuit board through the operation opening.

When it is necessary to remove the circuit board box, as long as the cover covered on the operation opening is opened, the terminal connected with the lead will be exposed, and the maintenance personnel may remove the lead from the terminal through the operation opening. In this way, the circuit board box is no longer connected to the air blower, and the maintenance personnel may entirely remove the circuit board box from the frame. In addition, the lead may be inserted into the circuit board box through the insertion opening provided on the wall of the circuit board box, and the lead may be fixed on the insertion opening by pressing the cover on an opened portion of a notch, thereby facilitating assembly and maintenance.

(4) The distance L1 from the first air suction port to the top surface is greater than the distance L2 from the second air suction port to the bottom surface. With such a design, the sensor storage unit is provided in the second air path.

When the motor is disposed at the first air suction port side, and the distance from the first air suction port to the top surface is greater than the distance from the second air suction port to the bottom surface, the amount of air entering the air blower from the first air suction port is less than that entering the air blower from the second air suction port, that is, the air volume flowing through the first air path is less than the air volume flowing through the second air path. In addition, since the motor is disposed in the first air path, the resistance of the first air path is relatively larger and the turbulence is relatively more. Since the air volume flowing through the second air path is more and the turbulence is relatively less, the sensor storage unit is disposed in the second air path, so that the humidity and the temperature may be correctly sensed, thereby improving the accuracy of the temperature and humidity sensed by the sensor storage unit.

(5) The first end of the sensor storage unit is disposed on the wall of the circuit board box, and the second end extends outwards from the circuit board box, and the air entrance port is disposed at the second end. With the above structure, the air entering the frame from the air inlet flows directly to the air entrance port opposite to the air inlet. The humidity and temperature of the air entering the frame may be more quickly and accurately detected by the sensor provided in the sensor storage unit. In addition, the air entrance port is provided on the second end of the sensor storage unit extending outwards from the circuit board box. In this way, the second end is closer to the air blower or the air inlet side, and more air enters the sensor storage unit. Therefore, although the circuit board box is provided in a space with a small air flow, the sensor may accurately detect the humidity and temperature of the air entering the frame, ensuring the accuracy of the temperature and humidity sensed by the sensor.

Figure 1:
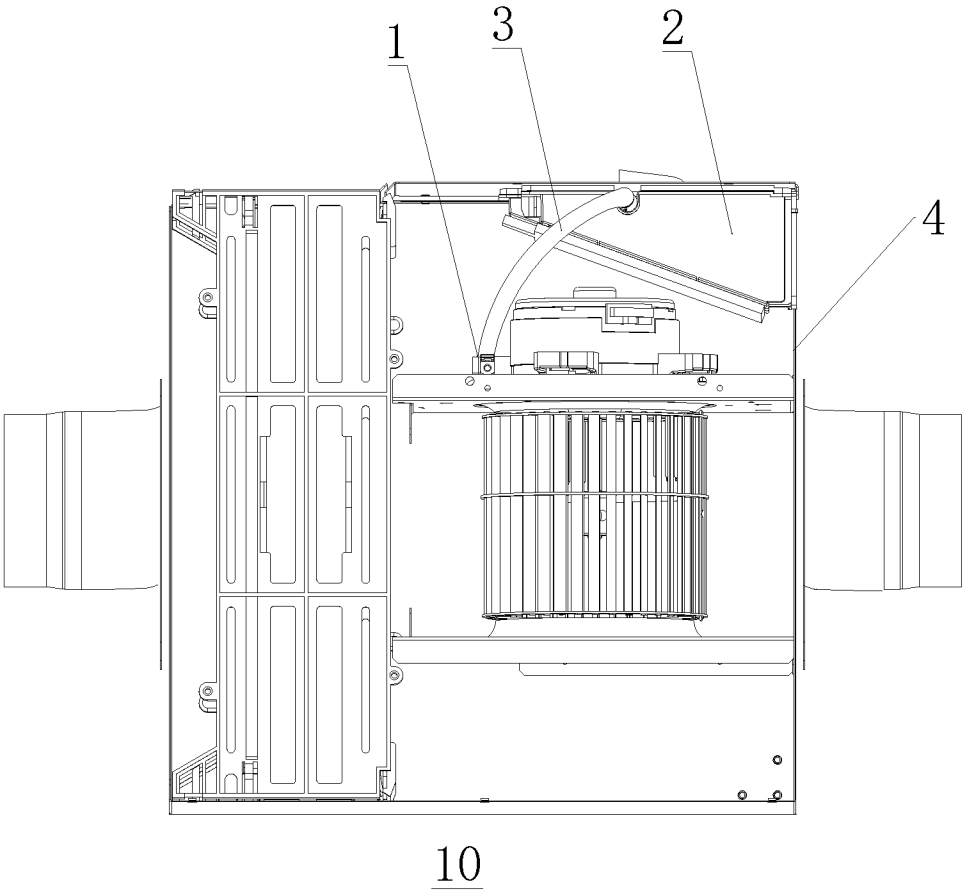
FIG. 1 is a schematic diagram of a connection between a sensor and a circuit board box in a ventilating device in the related art.

DESCRIPTION OF MAIN COMPONENTS OF EMBODIMENTS OF THE PRESENT DISCLOSURE IN THE DRAWINGS

100—frame;
111—top surface; 112—first side surface;
113—second side surface;
114—third side surface; 115—fourth side surface; 116—bottom surface;
A—air inlet; B—air outlet;
200—air blower; 210—motor;
220—fan; 230—casing;
231—first air suction port; 232—second air suction port; 234—air discharge port;
L1—distance from first air suction port to top surface 111;
L2—distance from second air suction port to bottom surface 116;
300—first air path; 400—second air path;
600—filter unit;
610—filter screen; 620—filter screen frame;
700—circuit board box;
711—operation opening; 711'-cover;
712—insertion opening;
720—control circuit board; 721—terminal;
722—lead;
800—sensor storage unit
811—air entrance port; 812—air exit port;
815—lid;
813—first end of sensor storage unit;
814—second end of sensor storage unit;
820—sensor; 822—sensor circuit board.

DETAILED DESCRIPTION OF PREFERRED EMBODIMENTS OF THE INVENTION

The present disclosure provides a ventilating device that can use less components, facilitate assembly and disassembly of components, and improve maintenance convenience by reasonably setting the positions of the circuit board box and the sensor storage unit.

To make the purpose, technical solutions, and advantages of the present application clearer, the following further describes the present disclosure in detail with reference to specific embodiments and the accompanying drawings.

Figure 2:
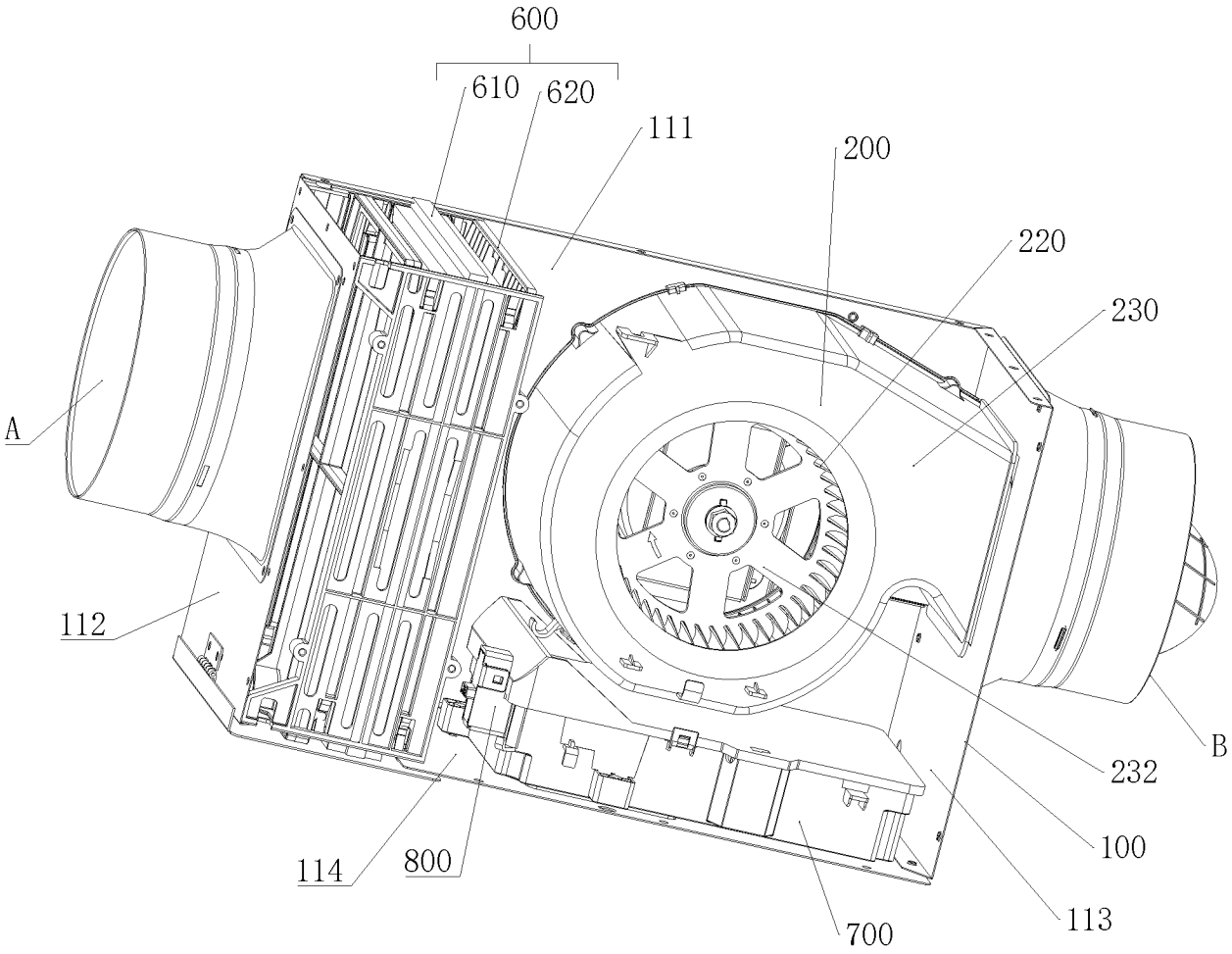
FIG. 2 is a schematic structural view of a ventilating device with a bottom surface removed according to an embodiment of the present disclosure.
Figure 3:
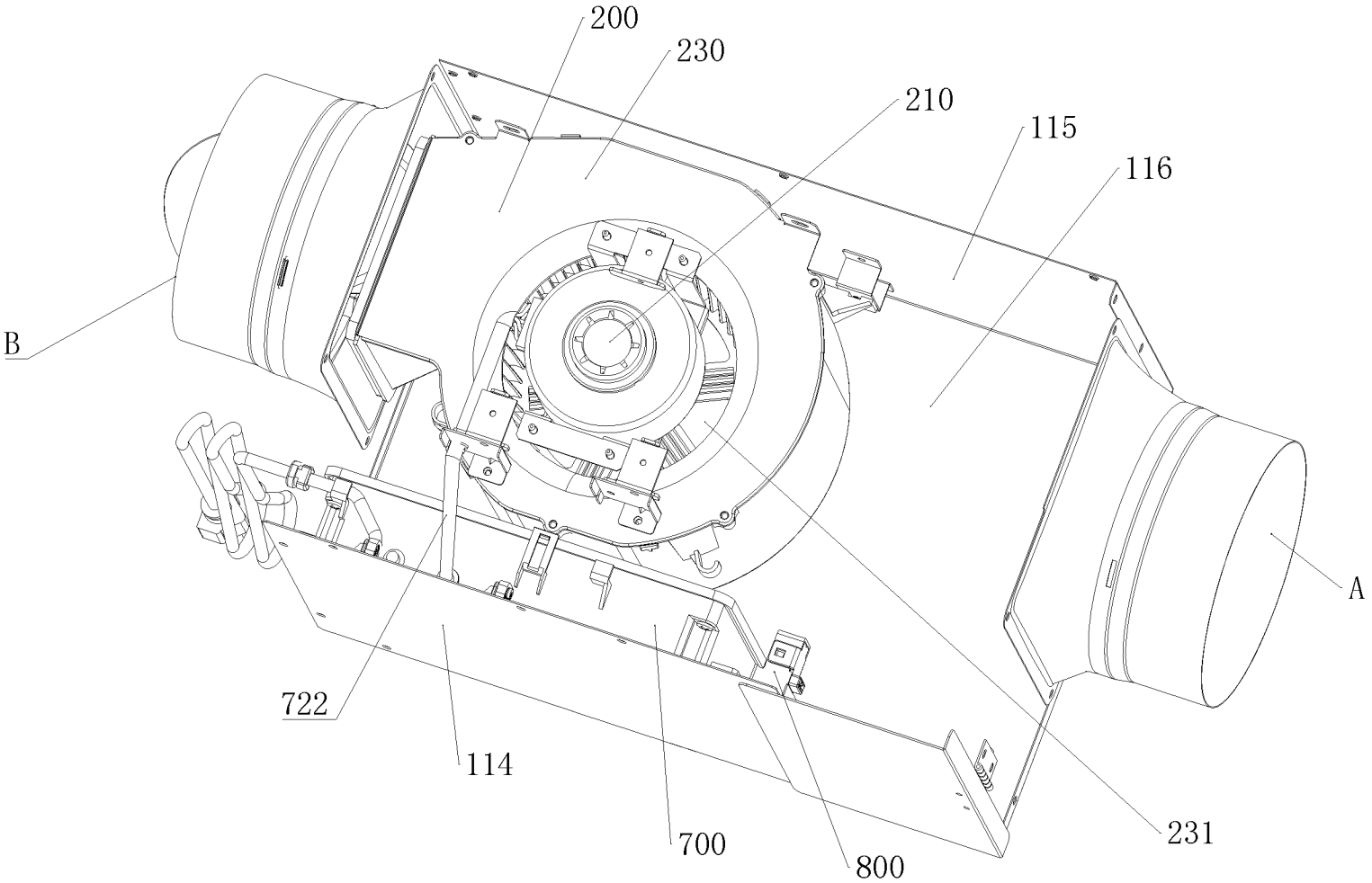
FIG. 3 is a schematic diagram of the ventilating device shown in FIG. 2 with a top surface and a filter unit removed and viewed from the top surface side.

In an exemplary embodiment of the present disclosure, a ventilating device is provided. FIG. 2 is a schematic structural view of a ventilating device with a bottom surface removed according to an embodiment of the present disclosure. FIG. 3 is a schematic diagram of the ventilating device shown in FIG. 2 viewed from the top surface side with a top surface and a filter unit removed. As shown in FIG. 2, the ventilating device in this embodiment includes a frame 100, an air blower 200, a sensor 820, a filter unit 600, a circuit board box 700, and a sensor storage unit 800. Among them, the circuit board box 700 and the sensor storage unit 800 are integrally molded into one piece. Among them, the circuit board box 700 is configured to store the control circuit board 720. The sensor storage unit 800 is configured to store a sensor 820 connected to the control circuit board 700 and capable of sensing humidity or temperature.

With the above configuration, when the sensor or the control circuit board needs to be maintained or removed, by only removing the circuit board box 700 integrally molded with the sensor storage unit 800, the sensor 800 or the control circuit board 720 then may be maintained or replaced as required without being assembled or disassembled separately, thereby easing their replacements and reducing labor-hours. At the same time, only one mold may be used to create the sensing unit and the circuit board box, which can save the mold cost. Due to easy assembly and disassembly of the components and the convenient maintenance, it may achieve the effect of saving cost.

The various components of the ventilating device in the present embodiment will be described in detail with reference to the accompanying drawings.

Referring to FIGS. 2 and 3, the frame 100 is of a hollow rectangular parallelepiped shape, including a top surface 111, a bottom surface 116 facing the top surface 111, and four side surfaces adjacent to the bottom surface 116 and the top surface 111, which are a first side surface 112, a second side surface 113, a third side surface 114 and a fourth side surface 115. The first side surface 112 and the second side surface 113 are opposite to each other, and the third side surface 114 and the fourth side surface 115 are opposite to each other.

The frame 100 is provide with an air inlet A that allows air to enter the frame 100 and an air outlet B that allow the air to be discharged from the frame 100. For example, when the ventilating device is set on a ceiling, the air inlet A is disposed at the first side surface 112; and the air outlet B is disposed at the second side surface 113 opposite to the first side surface 112 provided with the air inlet A.

As shown in FIG. 2, the filter unit 600 has a three-dimensional rectangular shape, and is provided on an upstream side of the air blower 200. The filter unit 600 includes a filter screen 610 and a filter screen frame 620, and may purify the air sucked from the air inlet A and block the entry of dust and fine particles.

Among them, the filter screen frame 620 has a three-dimensional rectangular parallelepiped shape for fixing the filter screen 610. The filter screen 610 is installed in the filter screen frame 620 and includes a filter screen achieving one or more filter effects or a plurality of filter screens each achieving one or more filter effects, Such as dust filter screen, deodorizing filter screen, or dust and deodorizing filter screen.

Referring to FIG. 3, the air blower 200 includes: a motor 210, a fan 220, and a casing 230, wherein after the motor 210 is energized, a rotary shaft is driven to rotate. The fan 220 is connected to the rotary shaft so as to generate an air flow via the rotation of the fan 220 driven by the rotary shaft of the motor 210. The fan 220 and the motor 210 are contained in the casing. The casing 230 has an air suction port and an air discharge port, and in this casing 230, a wind flow from the air suction port to the air discharge port is generated due to the rotation of the fan 220.

Figure 4:
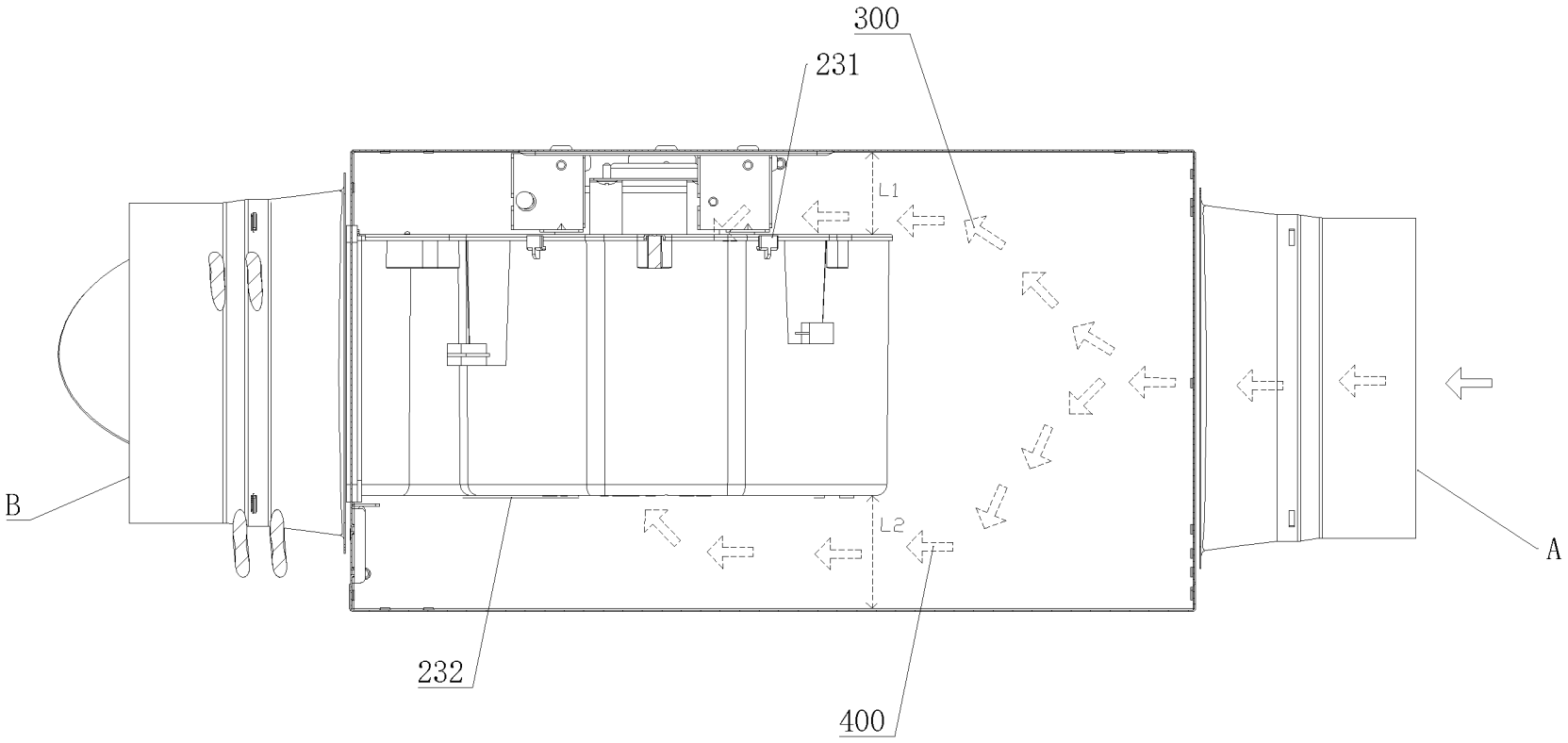
FIG. 4 is a side sectional view of the ventilating device shown in FIG. 2.

FIG. 4 is a side sectional view of the ventilating device shown in FIG. 2. As shown in FIG. 4, in the air blower 200, the air suction port is an opening that draws the air from the frame 100 into the casing 230. The casing 230 includes a first air suction port 231 and a second air suction port 232 acting as air suction ports, and an air discharge port that allows air to be discharged from the air blower 200. Among them, the first air suction port 231 and the second air suction port 232 provided on the casing 230 are opposite to each other. Under the action of the fan 220, air enters the air blower 200 from the first air suction port 231 and the second air suction port 232, and then is discharged from the air blower 200 via the air discharge port.

The first air suction port 231 is located at the motor 210 side of the casing 230 and faces the top surface 111. The air is sucked into the casing 230 from the back side of the casing 230, that is, from the top surface of the casing 230. The second air suction port 232 is opposed to the first air suction port 231. The air is sucked into the casing 230 from the front side of the casing 230, that is, from the bottom surface of the casing 230.

In particular, it should be noted that the distance from the first air suction port 231 to the top surface 111 of the frame 100 is greater than the distance from the second air suction port 232 to the bottom surface 116, which will be related to the setting position of the sensor storage unit in the present embodiment.

Referring to FIG. 4 continuously, the ventilating device in this embodiment further includes a first air path 300 and a second air path 400. The first air path 300 communicates the air inlet A with the first air suction port 231, that is, after the air is introduced from the air inlet A, it flows along the air path towards the first air suction port 231. The second air path 400 communicates the air inlet A with the second air suction port 232, that is, after the air is introduced from the air inlet A, it flows along the air path towards the second air suction port 232.

Referring to FIGS. 2, 3 and 4, the circuit board box 700 is disposed inside the frame 100 and is adjacent to the outer side of the casing 230. A control circuit board 720 is disposed therein. For example, the circuit board box 700 is disposed between the third side surface 114 of the frame and the air blower 200 or between the fourth side surface 115 of the frame and the air blower 200.

When the ventilating device is activated, the air enters the frame 100 through the air inlet A, and then enters the air blower 200 through the first air suction port 231 and the second air suction port 232, respectively, and then reaches the air outlet B through the air discharge port 234 and is discharged from the frame 100 via the air outlet B.

After the air enters the space between the air inlet A and the air blower 200 from the air inlet A, most of the air flows directly to the first air suction port 231 and the second air suction port 232. That is, most of the air flows through the space between the top surface 111 and the first air suction port 231 and the space between the bottom surface 116 and the second air suction port 232, only a small amount of the air flows through the space between the third side surface 114 and the air blower 200 or the space between the fourth side surface 115 and the air blower 200.

Therefore, the circuit board box 700 is disposed in the space between the third side surface 114 and the air blower 200, or the space between the fourth side surface 115 and the air blower 200, that is, the circuit board box 700 is disposed in a space with a small air flow. The effect of the circuit board box 700 upon the air flowing through the above space may be minimized, so that the circuit board box may be provided without affecting the air volume.

Figure 5A:
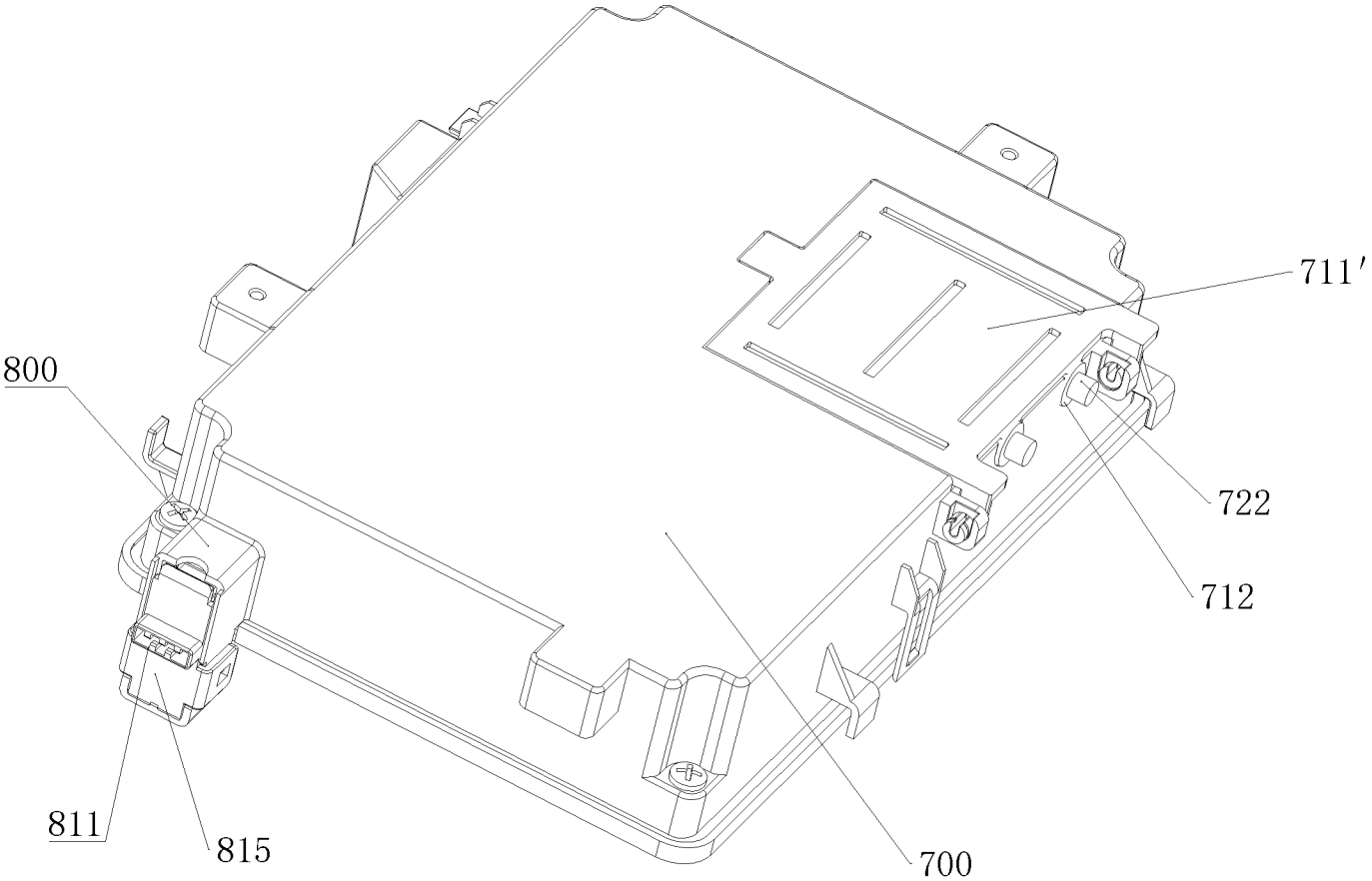
FIG. 5A is a schematic structural diagram of a circuit board box in the ventilating device shown in FIG. 2.
Figure 5B:
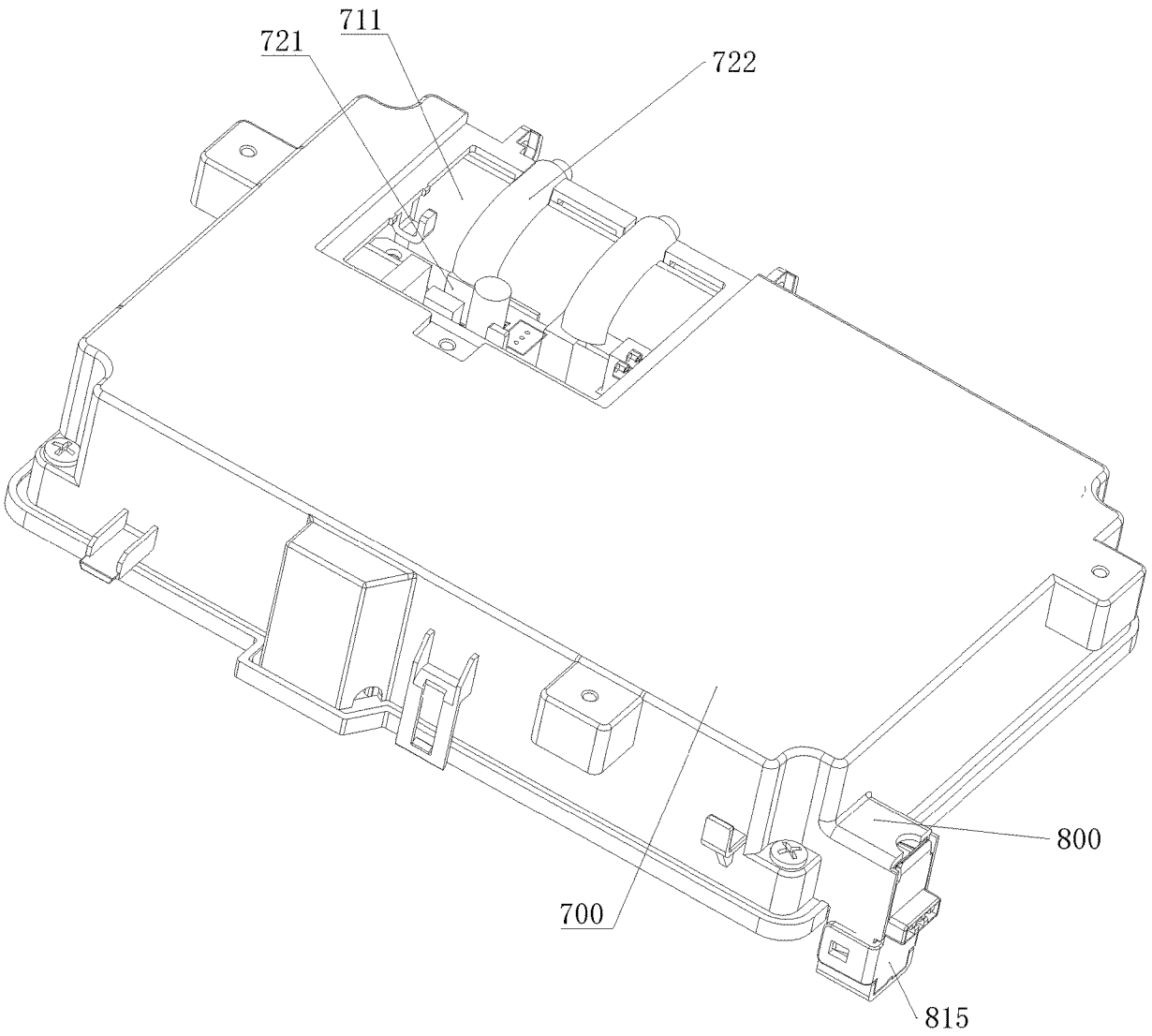
FIG. 5B is a schematic view of the circuit board box shown in FIG. 5A with a cover removed and viewed from another angle.

FIG. 5A is a schematic structural diagram of a circuit board box in the ventilating device shown in FIG. 2. FIG. 5B is a schematic view of the circuit board box shown in FIG. 5A with the cover removed and viewed from another angle.

As shown in FIGS. 5A, 5B and FIG. 3, the circuit board box 700 is provided with an operation opening 711 and an insertion opening 712. The control circuit board 720 is provided with a terminal 721.

The terminal 721 is connected to the air blower 200 through a terminal lead 722. After receiving an electrical signal, the control circuit board 720 controls the operation of the air blower 200 through the lead 722. The terminal 721 serves as a medium for connecting the lead 722 to the control circuit board 720.

The operation opening 711 is provided as an opening on a position opposite to the terminal 721 so that there is enough open area for the maintenance personnel to unplug or install the lead. The operation opening 711 is provided with a cover 711'.

In order to prevent dust from entering the operation opening 711, the cover 711' is fixed to the circuit board box 700 by the screw and latch structure so as to cover the operation opening 711.

The insertion opening 712 is an opening for allowing the lead 722 to be inserted into the circuit board box 700, and is disposed in form of a notch on the wall of the circuit board box 700 adjacent to the operation opening 711. After the lead is inserted into the notch, the lead 722 may be fixed on the insertion opening 712 by pressing the cover 711' on an opened portion of the notch.

The lead 722 may not only be a wire connecting the circuit board box 700 and the air blower 200, but also may be a wire that provides power for the control circuit board 720 and the operation of the air blower 200.

In this embodiment, In order to facilitate maintenance of the circuit board box, the operation opening 711 is provided at a position opposite to the terminal 721 provided on the control circuit board, and the lead 722 connected with the air blower can be freely attached to or detached from the control circuit board 720 through the operation opening 711.

When it is necessary to remove the circuit board box 700, as long as the cover 711' covered on the operation opening 711 is opened, the terminal 721 connected with the lead will be exposed, and the maintenance personnel may remove the lead from the terminal 721 through operation opening 711. In this way, the circuit board box 700 is no longer connected to the air blower 200, and the maintenance personnel may entirely remove the circuit board box 700 from the frame 100. In addition, the lead 722 may be inserted into the circuit board box 700 through the insertion opening 712 provided on the wall of the circuit board box 700, and the lead 722 may be fixed on the insertion opening 712 by pressing the cover 711' on the opened portion of the notch, thereby facilitating assembly and maintenance.

Figures 6A, 6B:
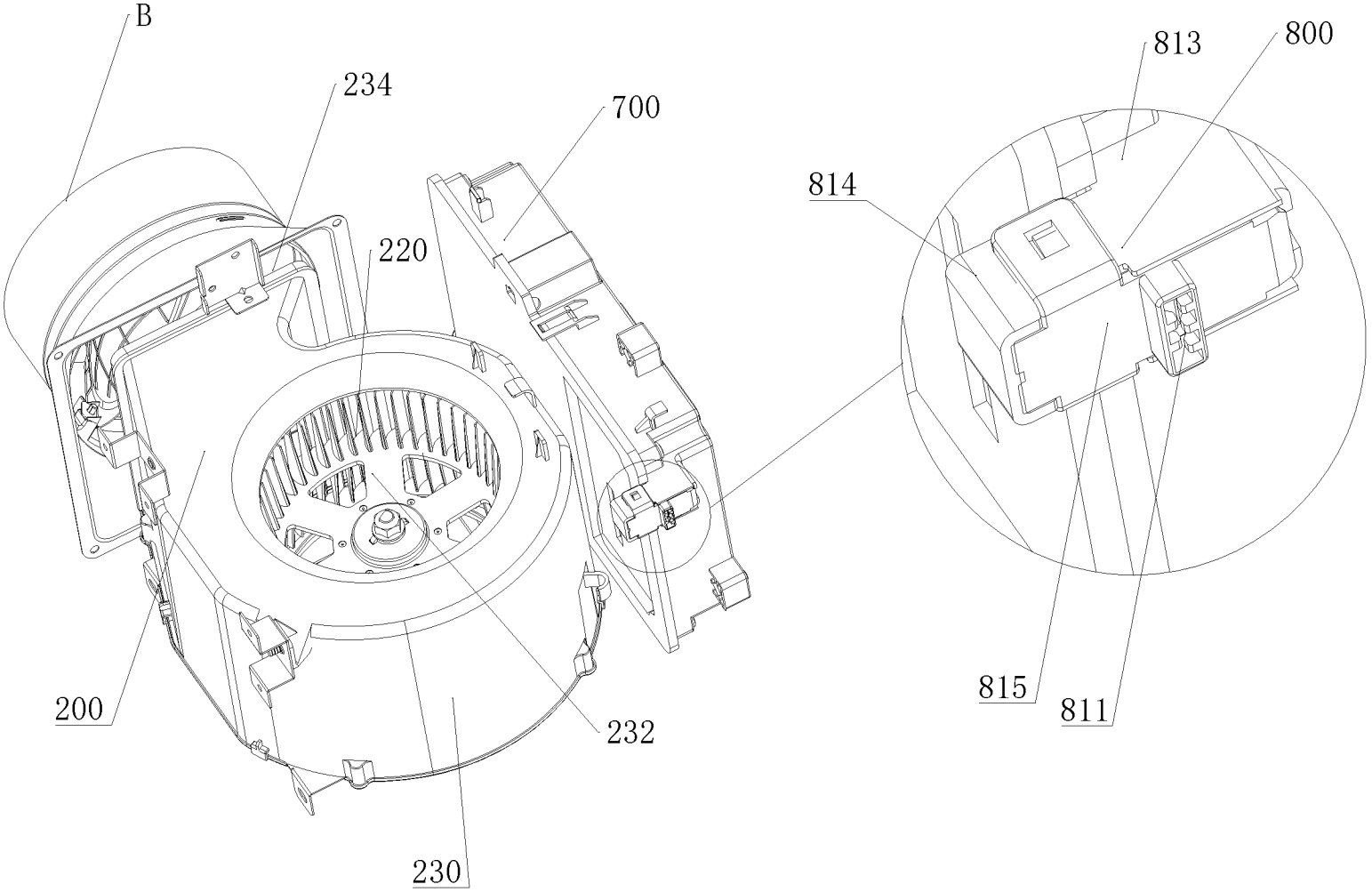
FIG. 6A is a schematic diagram of an air blower, a circuit board box, and a sensor storage unit in the ventilating device shown in FIG. 2.
FIG. 6B is an enlarged view of the sensor storage unit of FIG. 6A.

FIG. 6A is a schematic diagram of the air blower, the circuit board box, and the sensor storage unit in the ventilating device shown in FIG. 2. FIG. 6B is an enlarged view of the sensor storage unit of FIG. 6A. As shown in FIGS. 6A and 6B, the sensor storage unit 800 is formed outside the circuit board box 700, and is integrally molded into one piece with the circuit board box 700, and houses the sensor 820 and the sensor circuit board 822 therein. The sensor storage unit is covered by a lid 815.

As described above, the distance L1 from the first air suction port 231 to the top surface 111 is greater than the distance L2 from the second air suction port 232 to the bottom surface 116. With such a design, the sensor storage unit is provided in the second air path 400.

When the motor is disposed at the first air suction port 231 side, and the distance L1 from the first air suction port 231 to the top surface is greater than the distance L2 from the second air suction port 232 to the bottom surface, the amount of air entering the air blower from the first air suction port 231 is less than that entering the air blower from the second air suction port 232, that is, the air volume flowing through the first air path 300 is less than the air volume flowing through the second air path 400. In addition, since the motor is disposed in the first air path 300, the resistance of the first air path 300 is relatively larger and the turbulence is relatively more. Since the air volume flowing through the second air path 400 is more and the turbulence is relatively less, the sensor storage unit is disposed in the second air path, so that the humidity and the temperature may be correctly sensed, thereby improving the accuracy of the temperature and humidity sensed by the sensor storage unit.

Figure 7:
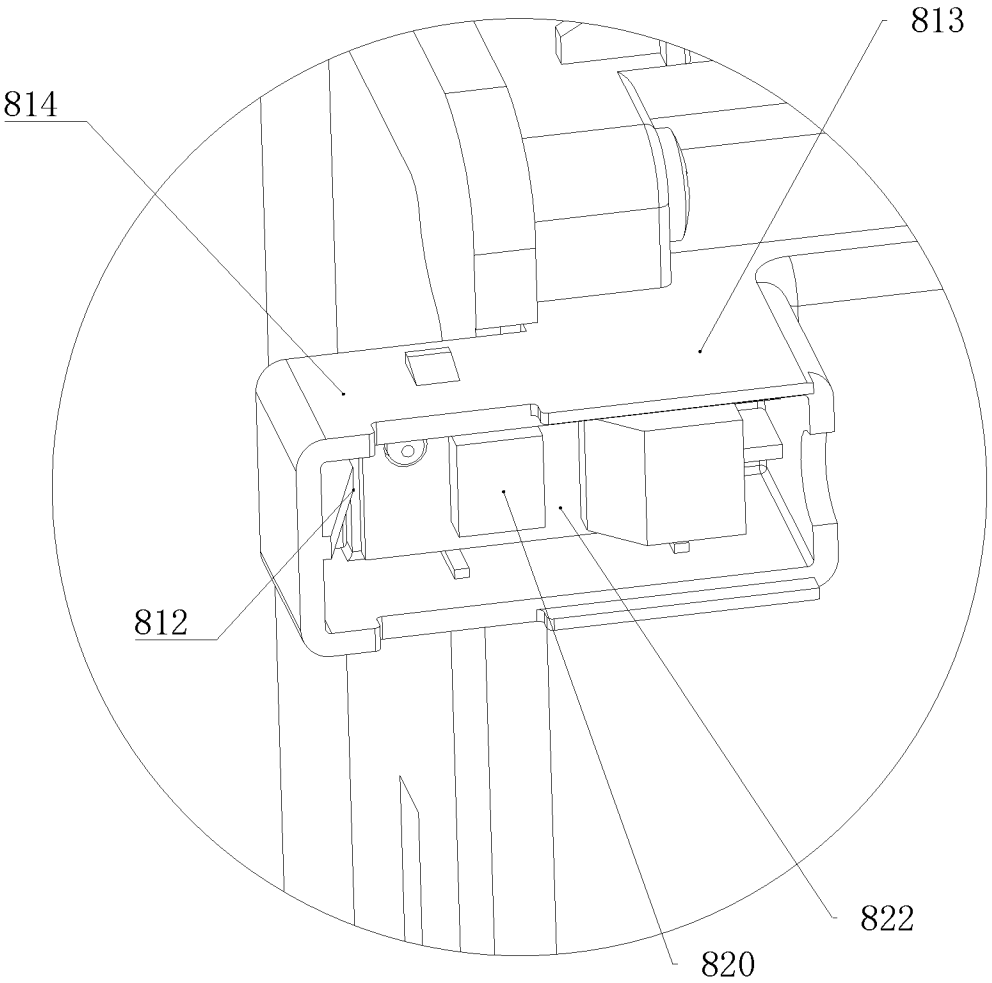
FIG. 7 is an internal schematic diagram of the sensor storage unit in the ventilating device shown in FIG. 2.

FIG. 7 is an internal schematic diagram of the sensor storage unit in the ventilating device shown in FIG. 2. As shown in FIG. 7, the sensor 820 is stored inside the sensor storage unit 800 and is connected with the sensor circuit board 822. The sensor 820 detects the humidity or/and the temperature of the air passing through the sensor storage unit.

The lid 815 is a cover that covers the sensor 820 and the sensor circuit board 822 stored in the sensor storage unit and constitutes a cap for a sensor storage unit. The sensor circuit board 822 is housed inside the sensor storage unit and controls the sensor 820.

Wherein, please refer to FIG. 7, the sensor storage unit 800 includes an air entrance port 811 and an air exit port 812. The air entrance port 811 is provided on the lid 815 of the sensor storage unit, that is, on a surface of the sensor storage unit 800 facing the air inlet A, and is an opening provided for allowing the air from the frame to enter the sensor storage unit. The air exit port 812 is an opening provided on the sensor storage unit and configured to allow the air to be discharged from the sensor storage unit 800.

It should be noted that the first end 813 of the sensor storage unit is disposed on the wall of the circuit board box, and the second end 814 of the sensor storage unit extends outwards from the circuit board box, and the air entrance port 811 is disposed at the second end 814. With the above structure, the air entering the frame 100 from the air inlet A flows directly to the air entrance port 811 opposite to the air inlet A. The humidity and temperature of the air entering the frame 100 may be more quickly and accurately detected by the sensor 820 provided in the sensor storage unit. In addition, the air entrance port 811 is provided on the second end 814 of the sensor storage unit 800 extending outwards from the circuit board box. In this way, the second end 814 is closer to the air blower or the air inlet side, and more air enters the sensor storage unit 800. Therefore, although the circuit board box is provided in a space with a small air flow, the sensor 820 may accurately detect the humidity and temperature of the air entering the frame 100, ensuring the accuracy of the temperature and humidity sensed by the sensor.

Heretofore, the embodiments of the present disclosure have been described in detail with reference to the accompanying drawings. It should be noted that, in the accompanying drawings or the specification, implementations not shown or described are all known to those of ordinary skill in the art and are not described in detail. In addition, the above-mentioned definitions of the elements and methods are not limited to the various specific structures, shapes or modes mentioned in the embodiments, and those skilled in the art can simply modify or replace them.

Based on the above description, those skilled in the art should have a clear understanding of the ventilating device of the present disclosure.

In summary, the present disclosure provides a ventilating device that may use less components, facilitate assembly and disassembly of components, and improve maintenance convenience by reasonably setting the positions of the circuit board box and the sensor storage unit, and has a strong application value and a comparatively better promotion and application prospects.

It should also be noted that the directional terms mentioned in the embodiments, such as "upper", "lower", "front", "rear", "left", "right", etc., refer only to the direction of the drawings, but do not limit the scope of protection of the present disclosure. Throughout the drawings, the same elements are denoted by the same or similar reference numerals. Since ambiguities in the understanding of the present disclosure may result, the conventional structures or constructions will be omitted.

Also, the shapes and sizes of the components in the drawings do not reflect actual sizes and proportions, but merely illustrate the contents of the embodiments of the present disclosure.

Moreover, the word "comprising" does not exclude the presence of elements or steps other than those listed in a claim. The word "a" or "an" preceding an element does not exclude the presence of a plurality of such elements.

The terms such as "first", "second", "third", etc. in the description and the claims used before corresponding elements do not mean that these elements have any ordinal number nor does they representing the order of one element and another element, or the order of manufacturing methods, the ordinal numbers is only used to make a clear distinction between one element with a certain name and another element with the same name.

The specific embodiments described above further describe the purpose, technical solutions and beneficial effects of the present disclosure in more detail. It should be understood that the above description is only specific embodiments of the present disclosure and is not intended to limit the present disclosure. Any modification, equivalent replacement, or improvement made within the spirit and principle of the present disclosure shall fall within the protection scope of the present disclosure.

What is claimed is:

1. A ventilating device, comprising:

a frame formed with an external profile;

an air inlet provided in the frame;

an air outlet provided in the frame;

an air blower for guiding air from the air inlet to the air outlet;

a control circuit board connected to the air blower and configured to control operation of the air blower; and a circuit board box for housing the control circuit board;

wherein the circuit board box comprises an integrally formed sensor storage unit for storing a sensor connected to the control circuit board and capable of sensing humidity or temperature; and the ventilating device further comprises:

a terminal connection to the air blower and provided on the control circuit board, the control circuit board and a lead of the air blower being connected to each other through the terminal; and an operation opening provided in the circuit board box and opposite of the terminal.

2. The ventilating device according to claim 1, further comprising:

a cover for covering the operation opening; and an insertion opening for guiding the lead to the circuit board box.

3. The ventilating device according to claim 1, wherein the air blower comprises:

a motor;

a first air suction port provided proximate to the motor;

a second air suction port opposite to the first air suction port;

an air discharge port for discharging air from the air blower; and a fan configured to guide air from the first air suction port and the second air suction port into the air blower and discharge the air from the air blower via the air discharge port simultaneously.

4. The ventilating device according to claim 3, wherein the frame comprises:

a first side surface provided with the air inlet;

a second side surface opposite to the first side surface and provided with the air outlet corresponding to the air discharge port;

a top surface adjacent to the first side surface and facing the first air suction port;

a bottom face adjacent to the first side surface and facing the second air suction port; and a third side surface and a fourth side surface that are adjacent to the top surface and the bottom surface, respectively;

wherein, the circuit board box is provided between the third side surface and the air blower or between the fourth side surface and the air blower.

5. The ventilating device according to claim 4, further comprising:

a first air path for communicating the air inlet with the first air suction port; and a second air path for communicating the air inlet with the second air suction port;

wherein a distance from the first air suction port to the top surface is greater than a distance from the second air suction port to the bottom surface, and the sensor storage unit is provided at a second air path side.

6. The ventilating device according to claim 1, wherein the sensor storage unit is provided with an air entrance port provided in a face of the sensor storage unit facing the air inlet and configured to guide the air into the sensor storage unit.

7. The ventilating device according to claim 6, wherein a first end of the sensor storage unit is provided on a wall of the circuit board box, and a second end of the sensor storage unit extends outwards from the circuit board box.

8. The ventilating device according to claim 7, wherein the air entrance port is provided at the second end.

9. A ventilating device, comprising:

a frame formed with an external profile;

an air inlet provided in the frame;

an air outlet provided in the frame;

an air blower for guiding air from the air inlet to the air outlet;

a control circuit board connected to the air blower and configured to control operation of the air blower; and a circuit board box for housing the control circuit board;

wherein the circuit board box comprises an integrally formed sensor storage unit for storing a sensor connected to the control circuit board and capable of sensing humidity or temperature, wherein the air blower comprises:

a motor;

a first air suction port provided proximate to the motor;

a second air suction port opposite to the first air suction port;

an air discharge port for discharging air from the air blower; and a fan configured to guide air from the first air suction port and the second air suction port into the air blower and discharge the air from the air blower via the air discharge port simultaneously.

10. The ventilating device according to claim 9, wherein the frame comprises:

a first side surface provided with the air inlet;

a second side surface opposite to the first side surface and provided with the air outlet corresponding to the air discharge port;

a top surface adjacent to the first side surface and facing the first air suction port;

a bottom face adjacent to the first side surface and facing the second air suction port; and a third side surface and a fourth side surface that are adjacent to the top surface and the bottom surface, respectively;

wherein, the circuit board box is provided between the third side surface and the air blower or between the fourth side surface and the air blower.

11. The ventilating device according to claim 10, further comprising:

a first air path for communicating the air inlet with the first air suction port; and a second air path for communicating the air inlet with the second air suction port;

wherein a distance from the first air suction port to the top surface is greater than a distance from the second air suction port to the bottom surface, and the sensor storage unit is provided at a second air path side.

12. The ventilating device according to claim 9, wherein the sensor storage unit is provided with an air entrance port provided in a face of the sensor storage unit facing the air inlet and configured to guide the air into the sensor storage unit.

13. The ventilating device according to claim 12, wherein a first end of the sensor storage unit is provided on a wall of the circuit board box, and a second end of the sensor storage unit extends outwards from the circuit board box.

14. The ventilating device according to claim 13, wherein the air entrance port is provided at the second end.

15. A ventilating device, comprising:

a frame formed with an external profile;

an air inlet provided in the frame;

an air outlet provided in the frame;

an air blower for guiding air from the air inlet to the air outlet;

a control circuit board connected to the air blower and configured to control operation of the air blower; and a circuit board box for housing the control circuit board;

wherein the circuit board box comprises an integrally formed sensor storage unit for storing a sensor connected to the control circuit board and capable of sensing humidity or temperature, the sensor storage unit is provided with an air entrance port provided in a face of the sensor storage unit facing the air inlet and configured to guide the air into the sensor storage unit.

16. The ventilating device according to claim 15, wherein a first end of the sensor storage unit is provided on a wall of the circuit board box, and a second end of the sensor storage unit extends outwards from the circuit board box.

17. The ventilating device according to claim 16, wherein the air entrance port is provided at the second end.

* * * * *